United States Patent [19]

Johnson et al.

[11] 3,949,589

[45] Apr. 13, 1976

[54] REMOVABLE SUBDIE

[75] Inventors: Robert R. Johnson, Ludlow; Robert E. Jones, Clarendon; John A. Zwald, Warren, all of Pa.

[73] Assignee: GTE Sylvania Incorporated, Stamford, Conn.

[22] Filed: Feb. 5, 1975

[21] Appl. No.: 547,190

[52] U.S. Cl. ..... 72/413; 72/456; 72/472

[51] Int. Cl.[2] ..... B21D 37/02; B21D 37/14; B21J 13/02; B21J 13/04

[58] Field of Search ..... 72/456, 413, 414, 415, 72/416, 472

[56] References Cited

UNITED STATES PATENTS 2,851,081 9/1958 Klasek ..... 72/414

3,446,169 5/1969 Heldenbrand ..... 72/414

*Primary Examiner*—C. W. Lanham
*Assistant Examiner*—E. M. Combs
*Attorney, Agent, or Firm*—Norman J. O'Malley; Lawrence R. Fraley; Donald R. Castle

[57] ABSTRACT

There is described a subdie assembly adapted for easy removal from a larger die apparatus. The assembly comprises a die retention means, die means, guide means, tool retention means and workpiece engaging means both movably oriented on said guide means for aligned movement toward and away from the die retention means, and first and second resilient spacing means for maintaining the tool retention means in spaced relationship with the workpiece engaging means and the die retention means respectively.

11 Claims, 7 Drawing Figures

REMOVABLE SUBDIE

BACKGROUND OF THE INVENTION

The present invention relates to die apparatus and more particularly to die apparatus capable of performing a series of operations on a designated workpiece. Even more particularly this invention relates to die apparatus capable of performing a series of highly precisioned operations on relatively small workpieces.

Die apparatus of the variety described have usually comprised an upper ram member and a lower base member. Secured within or affixed to the upper ram is a tool retaining plate or similar member in which is positively retained a plurality of tool members adapted for engaging the workpiece during activation of the apparatus to accomplish the prescribed operations. Also included in the die apparatus is a workpiece engaging member, or stripper plate, which positively seats against the workpiece during the downward stroke of the tool members. The stripper plate performs several necessary functions with regard to the die operation, among these being positive securement of the workpiece in position and retention of the workpiece against the die member itself during withdrawal of the described tools. The die member in turn is usually positively retained within a die holder or similar member which in turn is secured to the described base member.

As can be appreciated, in the performance of highly precisioned operations on relatively small workpieces of usually very thin nature, the precisioned tool members are highly subjective to wear, deforming, and other similar detrimental effects. Accordingly, it is periodically necessary to remove these members to perform required maintenance, replacement, etc. Heretofore, this has required a complete shutdown of the die apparatus and corresponding extensive disassembly procedures to remove the malfunctioning part. This has been also necessary when only a single tool member became defective. Needless to say, the described maintenance steps necessary to repair the die apparatus have been excessively time consuming and therefore costly by manufacturing standards.

It is believed therefore that a subdie assembly adapted for facile removal from a larger die apparatus, thus resulting is less downtime for the apparatus during periods of repair, would constitute an advancement in the art.

OBJECTS AND SUMMARY OF THE INVENTION

It is therefore a primary object of this invention to provide a subdie assembly which is easily removable from a die apparatus thus facilitating repair to said apparatus.

It is a further object of this invention to provide a subdie assembly of the nature described which is adaptable to die apparatus capable of performing highly precisioned operations on relatively small workpieces.

In accordance with a primary aspect of the present invention, there is provided a subdie assembly adapted for being easily removed from a die apparatus. The assembly comprises a die retention means affixed to and adapted for removal from the base of the die apparatus. The assembly further comprises a die means, guide means, tool retention means and workpiece engaging means both movably oriented on the guide means for aligned movement toward and away from the die retention means, a tool means, and first and second resilient spacing means for maintaining the tool retention means in spaced relationship with the workpiece engaging means and the die retention means, respectively.

DESCRIPTION OF THE PREFERRED EMBODIMENTS

For a better understanding of the present invention, together with other and further objects, advantages and capabilities thereof, reference is made to the following disclosure and appended claims in connection with the above-described drawings.

Figure 1:
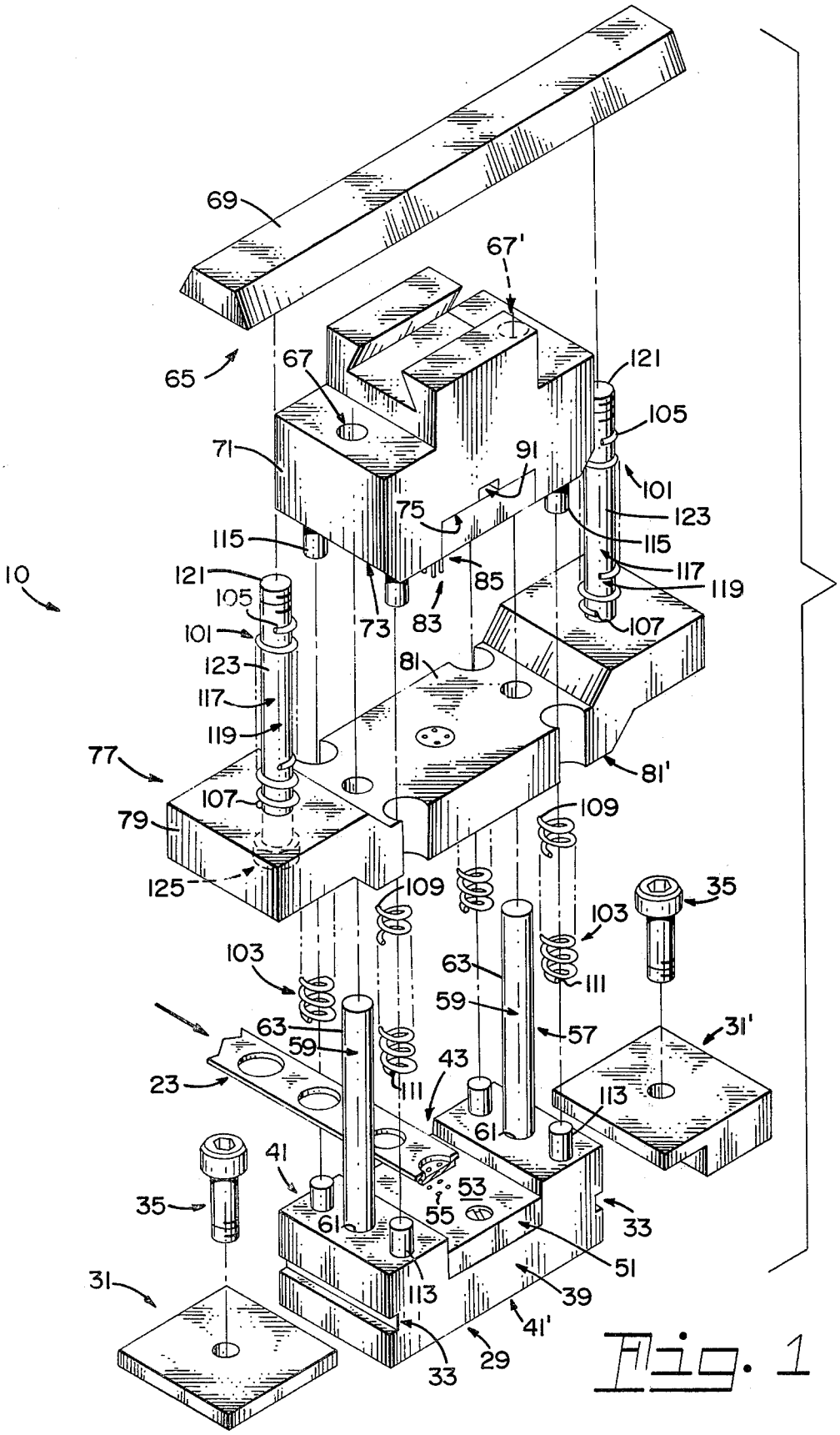
FIG. 1 is an exploded isometric view of the subdie assembly in accordance with a preferred embodiment of the invention.
Figure 2:
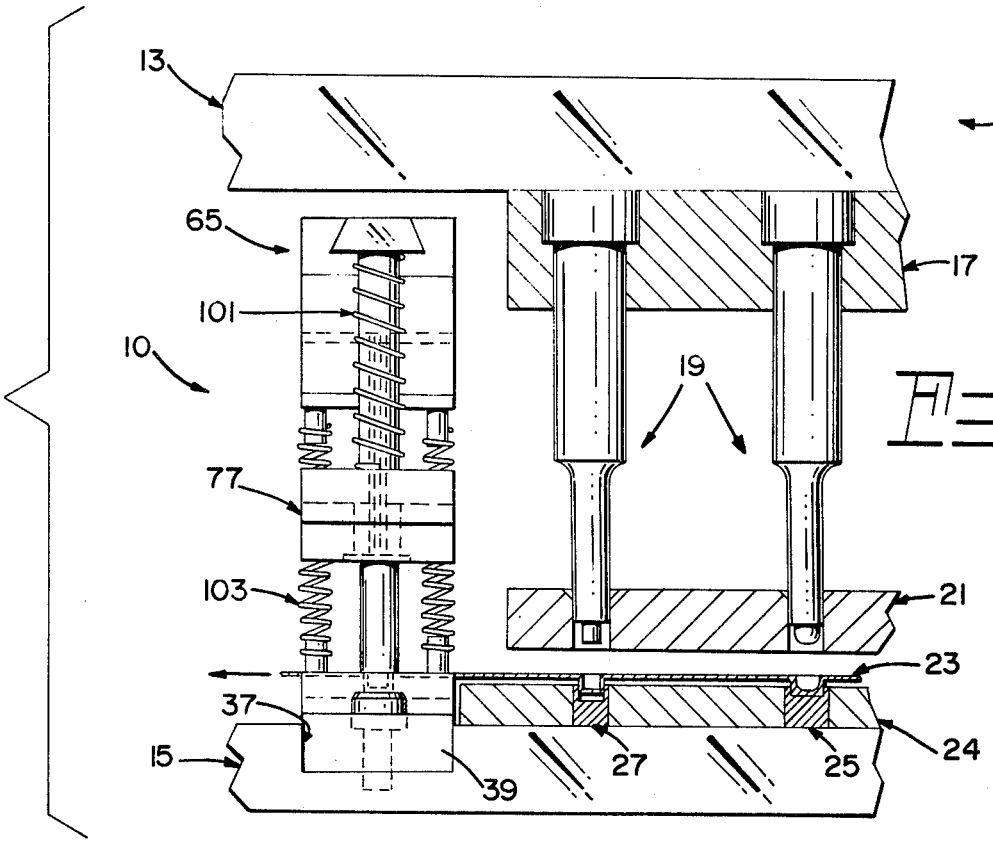
FIG. 2 is a side elevational view of the subdie assembly of FIG. 1 as positioned within a die apparatus.

With particular reference to FIG. 1, there is illustrated a subdie assembly 10 in accordance with a preferred embodiment of the present invention. Subdie assembly 10 is adapted for being readily removed from a larger die apparatus 11 as shown in FIG. 2. Die apparatus 11 of the type illustrated are well known in the art and include as working components at least one upper ram member 13 and a lower base member 15. Die apparatus of this variety also usually include a tool retaining member 17 in which are positioned a series of working tool members 19. Members 19 are downwardly displaced when upper ram member 13 is actuated (usually mechanically) and move through a stripper plate 21 to engage a positioned workpiece 23. The workpiece is usually mounted on a die retainer plate 24 having a series of die members 25 and 27 positioned therein. Thus it can be seen that die apparatus 11 performs a series of operations on workpiece 23 as the workpiece moves through the apparatus. As previously stated, the aforementioned die apparatus is well known in the art and further description is not believed necessary.

With reference back to FIG. 1, the illustrated subdie assembly is adapted for performing a specified operation on the aforedescribed workpiece 23 within the larger die apparatus 11 as the workpiece moves through the apparatus. As will be described with reference to the provided subdie assembly 10, the assembly is adapted for being readily removed from the aforementioned die apparatus, thus constituting a main feature of the present invention.

Subdie assembly 10 performs the specified operation on workpiece 23 as the workpiece moves in the direction indicated. The operation, as will be described, is one of relatively high precision and therefore requires demanding stipulations with regard to aligning and positioning of the various components of the assembly. The operation illustrated in FIG. 1 is the punching of a plurality (four) of openings within predefined indentations in material 23 as each of these indentations are sequentially positioned within assembly 10. The resulting apertures are each approximately 0.020 inches in diameter, thus indicating the level of precision required for the defined operation. As can be appreciated, when performing operations of such precise caliber, it is periodically necessary to replace various working components of subdie assembly 10.

In the previously known die apparatus as heretofore described, replacement or repair of precisioned working components within the apparatus has required a complete shutdown of the apparatus itself to achieve said maintenance. As can be appreciated, this in turn resulted in the loss of many manufacturing hours used to produce the required components. The proposed present invention precludes this undesirable necessity by providing an assembly which is readily removable from the larger die apparatus 11 without requiring extensive disassembly of the apparatus as previously required. Thus, an operator of the apparatus can readily place a substitute assembly substantially similar to that being removed within the die apparatus and in turn repair the removed assembly while the die apparatus continues functioning.

To provide this versatility, removable subdie assembly 10 is illustrated in FIG. 1 as comprising a die retention means 29 which is affixed to the lower base member 15 of die apparatus 11 (shown in FIG. 2) and is adapted for being readily removed therefrom. This removal in turn is accomplished by loosening and/or removal of a pair of respective retaining plate members 31 and 31'. Plate members 31 and 31' mate with and serve to positively secure die retention means 29 to the aforementioned base member 15. This is accomplished by each of the retaining members 31 and 31' engaging a corresponding slot 33 located within the respective sides of retention means 29. Members 31 and 31' are loosened in their affixed positions by the corresponding loosening of a respective pair of retention screws 35, each of which secure respective plates 31 and 31' to base 15. In the preferred method for removal of assembly 10, retention plate member 31 is simply loosened and the corresponding screw 35 not removed. Accordingly, retaining block 31' is removed from its established position after previous removal of the remaining screw 35. As illustrated in FIG. 2, retaining member 31' and retention means 29 are both adapted for being slidably positioned within a corresponding channel 37 of lower base 15. As will be illustrated, lateral removal of the subdie assembly 10 from base 15 can now be easily achieved.

In the preferred embodiment of the invention as illustrated in FIG. 1, die retention means 29 comprises a housing member 39 having upper and lower opposing surfaces 41 and 41' respectively. Lower surface 41', as shown, is adapted for engaging the described base member 15 while upper surface 41 includes a recessed portion 43 therein. Securedly positioned within recessed portion 43 of housing 39 is the preferred die means 51 of the present invention. As illustrated, die means 51 comprises a receiving member 53 having at least one opening 55 therein. As shown, receiving member 53 includes four openings 55 therein for providing the desired specified operation. It is understood, however, that in the broader aspects of the present invention, die means 51 need only comprise one opening 55 to perform a die operation of the nature described.

Removable subdie assembly 10 further comprises a guide means 57 having a first portion affixed to die retention means 29 and a second portion extending therefrom. In the preferred embodiment of the invention, guide means 57 comprises at least two upstanding rod members 59, each having a first end 61 securedly retained within the upper surface 41 of die retention means 29. Accordingly, each rod member 59 has a second extending end portion 63 which in turn extends from upper surface 41 of retention means 29 in a substantially upward direction with regard to the orientation of subdie assembly 10 within apparatus 11.

Movably oriented on the described extending second end portions 63 of rod member 59 is a tool retention means 65. As shown, tool retention means 65 includes a pair of opposingly located openings 67 and 67' (shown hidden) adapted for having rod members 59 slidably positioned therein. Accordingly, tool retention means 65 is able to move in aligned manner toward and away from die retention means 29 during operation of larger die apparatus 11. Movement of tool retention means 65 toward die retention means 29 is achieved when an elongated bar member 69 of means 65 is engaged by the aforedescribed upper ram 13. As shown in FIG. 2, bar 69 does not engage ram 13 when the die apparatus 11 is in its furthermost upward position. That is, when the upper ram 13 of die apparatus 11 is not moving the tool members 19 in the downward direction to accomplish their necessary operations, tool retention means 65 of subdie assembly 10 is not engaged by ram 13. This feature further facilitates removal of the subdie assembly 10 from die apparatus 11. In the preferred embodiment of the invention, tool retention means 65 further comprises a housing member 71 having a lower surface 73 which includes an indented portion 75 for retaining the tool means of the present invention. The previously described bar 69 is securedly retained within housing 71 by the provision of a male-female dovetail mating relationship. That is, the bar 69 serves as the male member while the uppermost portion of housing 71 comprises the female receptive portion.

Also movably oriented on the extending second portions of rods 59 is workpiece engaging means 77. As shown, workpiece engaging means 77 is positioned substantially between die retention means 29 and tool retention means 65 and is adapted for aligned movement toward and away from retention means 29 during performance of the aforementioned specified operation to workpiece 23. Workpiece engaging means 77 comprises an elongated plate member 79 having upper and lower opposing surfaces 81 and 81' respectively. Lower surface 81' is adapted for engaging workpiece 23 when workpiece 23 is positioned on die means 51. As can be appreciated, the engagement of lower surface 81' of workpiece engaging means 77 assures positive positioning of workpiece 23 when the described specified operation is to be accomplished. As will be further described, workpiece engaging means 77 also serves to retain workpiece 23 against die means 51 during withdrawal of the tool means of assembly 10. This added feature assures that workpiece 23 will be positively retained in position within apparatus 11 in order that its continued progress through the apparatus may be achieved in the necessary aligned manner.

Figure 6:
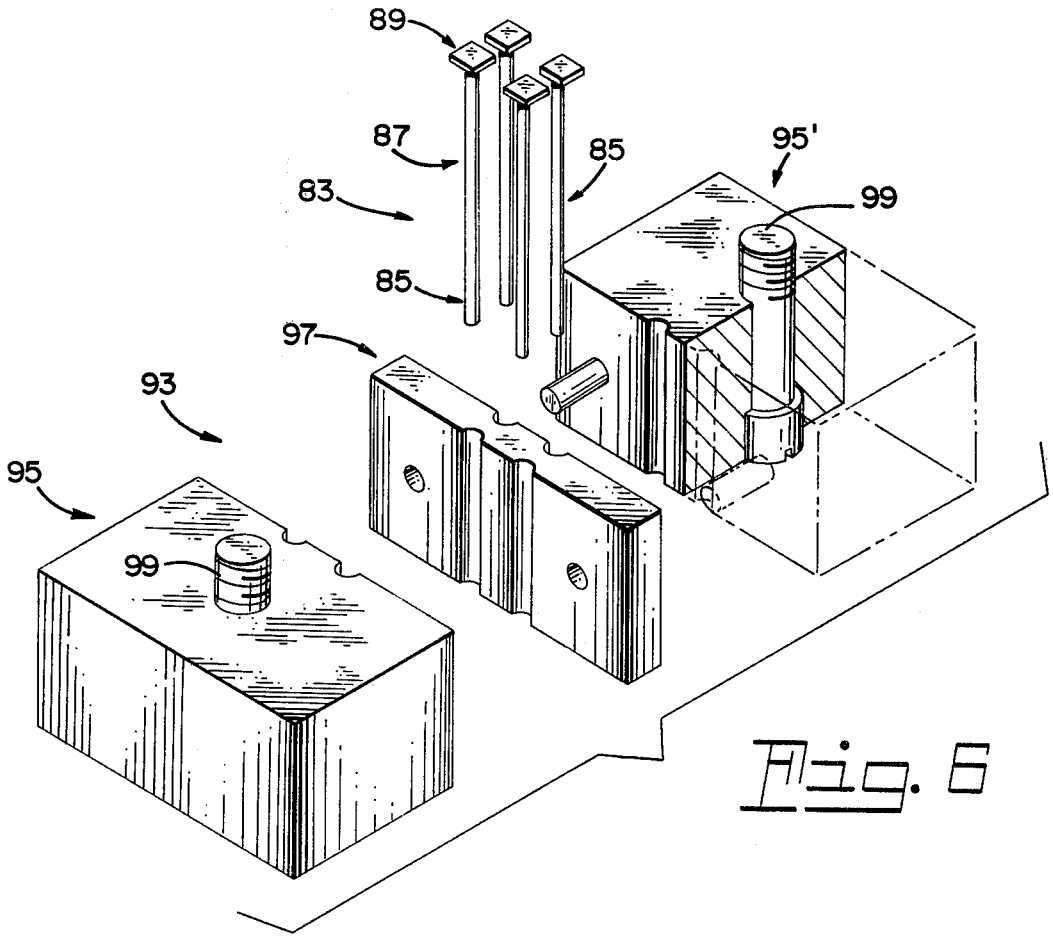
FIG. 6 is an enlarged isometric view of the preferred tool means and respective holder of the present invention.

As shown in FIG. 1 and more particularly in FIG. 6, subdie assembly 10 further comprises a tool means 83 which is securedly positioned within tool retention means 65 and has a working portion 85 extending from tool retention means 65 and adapted for passing through workpiece engaging means 77 to perform the described specified operation on workpiece 23 when tool retention means 65 moves in the described direction toward die retention 29. As more specifically illustrated in FIG. 6, tool means 83 comprises at least one punch member 87 having a first end portion 89 and a protruding working end portion 85. In the preferred embodiment of the present invention, tool means 83 comprises four individual punch members 87 each having their respective first end portions 89 positively secured within tool retention means 65. With reference to FIG. 6, this is achieved by positioning first end portions 89 within grooved portion 91 (see FIG. 1) of indented portion 75. To provide this securement, a corresponding multipiece block member 93 is provided. Block 93 comprises a pair of opposing end portions 95 and 95' respectively and an intermediate portion 97. In assembly, the described punch members are positioned within the assemblied block 93 and then the entire assembly is affixed within indented portion 75 of housing 71 via two retaining screws 99. Thus it can be seen that repair to each of the punch members 87 is facilitated by a corresponding relative ease of disassembly of block 93 after its removal from housing 71.

With reference back to FIG. 1, subdie assembly 10 is illustrated as further comprising a first resilient spacing means 101 which is positioned between tool retention means 65 and workpiece engaging means 77 for maintaining said members in the required spaced relationship. Subdie assembly 10 is also shown comprising a second resilient spacing means 103 which in turn is positioned between tool retention means 65 and die retention means 25 for maintaining each of these members in spaced relationship. In the preferred embodiment of the invention, first resilient spacing means and second resilient spacing means each comprise a plurality of spring members. The number of spring members preferred for first resilient spacing means 101 is two, each having a first end portion 105 positioned in engaged relationship to tool retention means 65 and a second end portion 107 positioned in engaged relationship to engaging means 77. Accordingly, second resilient spacing means 103 comprises a plurality of spring members (preferably four) each having a first end portion 109 positioned in engaged relationship to tool retention means 65 and a second end portion 111 positioned in engaged relationship to die retention means 29. The respective part that each of the aforementioned resilient spacing means plays with regard to the operation of assembly 10 will be more fully illustrated with the description of FIGS. 3–5. The described second resilient spacing means are positively aligned within assembly 10 by positioning their lower portions on a pair of upstanding pins 113 securedly positioned within die retention means 29 and their upper portions 109 about lower extending ends 115 on tool retention means 65.

Though not to be considered within the broader aspects of the present invention, subdie assembly 10 is illustrated in FIG. 1 as also comprising a delay means 117 for providing delayed movement of workpiece engaging means 77 away from die retention means 29 with resect to the described movement of tool retention 65 away from die retention means 29. As can be seen, delay means 117 is oriented within spacing means 101 and comprises at least two elongated members 119 having a first end portion 121 adapted for being affixed to bar 69 of tool retention means 65, an intermediate portion 123 for being movably oriented within workpiece engaging means 77 and a second end portion 125 for postively engaging workpiece engaging means 77 during movement of tool retention means 65 away from die retention means 29. The operation of the described delay means 117 will also be more fully illustrated with the description of FIGS. 3–5.

In referring to FIG. 2, the relative positioning of subdie assembly 10 within apparatus 11 is illustrated. As shown, housing 39 of die retention means 29 is securedly positioned within channel 37 of lower base member 15. Aslo shown in FIG. 2 are the tool retention means 65, workpiece engaging means 77, first resilient spacing means 101, and second resilient spacing means 103.

Figure 3:
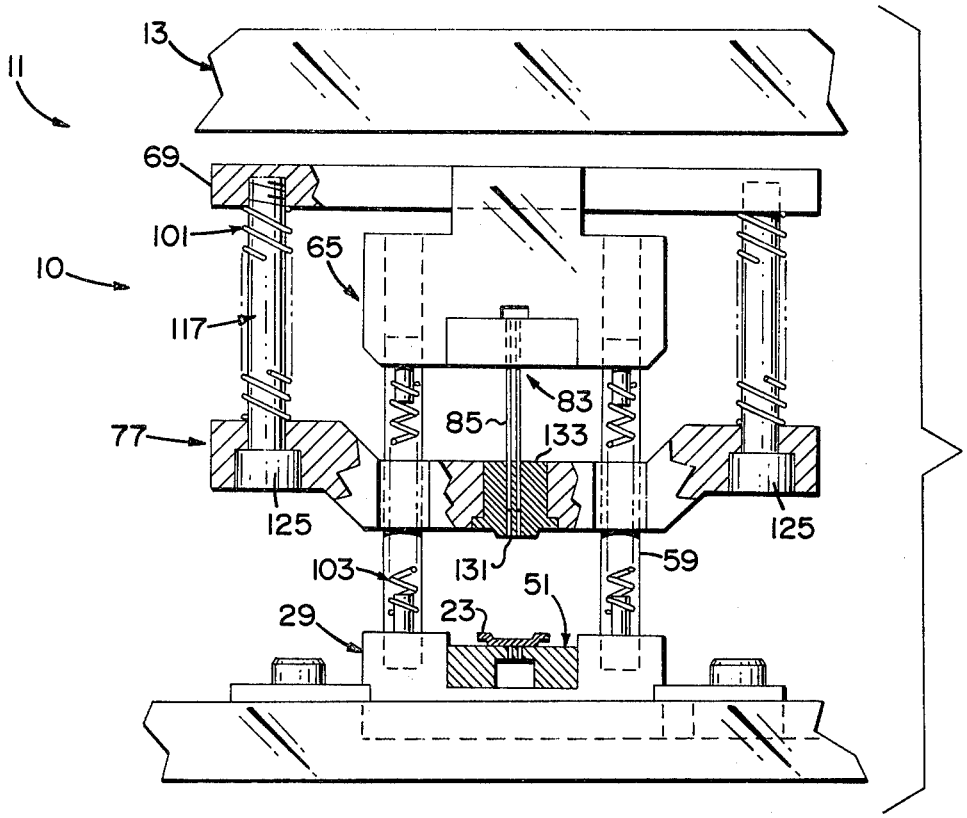
FIGS. 3–5 illustrate the various movements of the components of the present invention during its operation.
Figure 4:
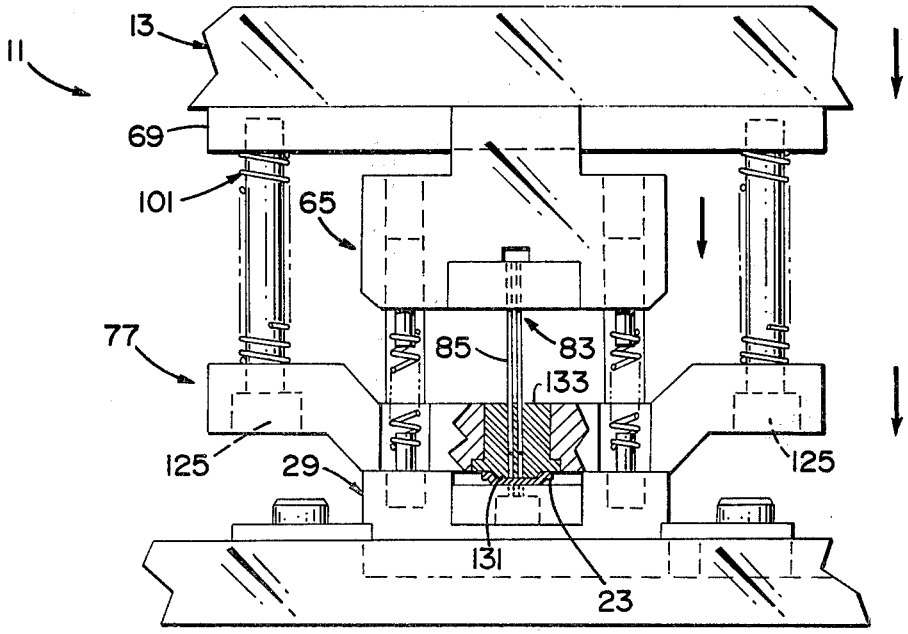
Figure 5:
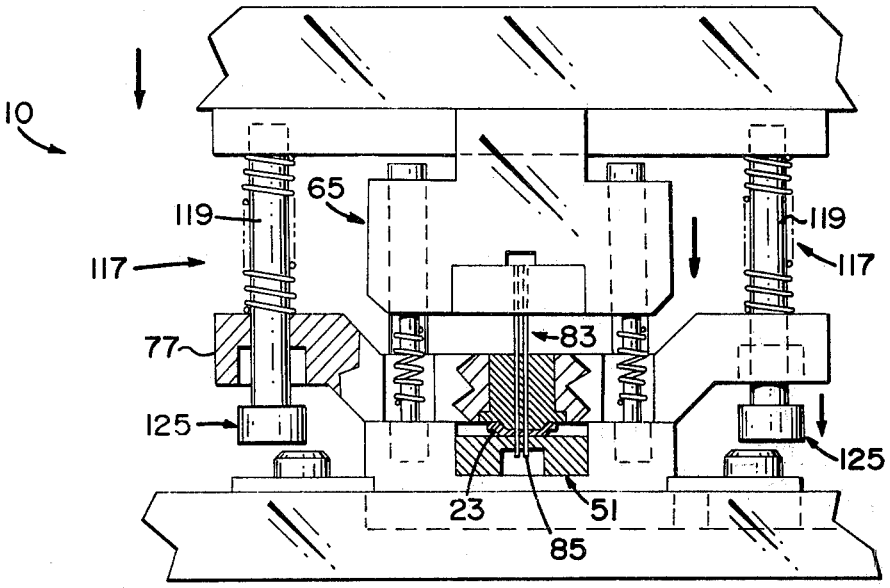

In referring to FIGS. 3–5, the respective positions of subdie assembly 10 are shown as the assembly accomplishes the described specified operation. In FIG. 3, subdie assembly 10 is illustrated in the open position. That is, bar 69 of the assembly has not been engaged by the upper ram 13 of die apparatus 11. Strip 23 is illustrated as being positioned on die means 51 which in turn is positively secured within die retention means 29. Workpiece engaging means 77 is in its uppermost open position and not engaging workpiece 23. As shown in cross section, the working portions 85 of tool means 83 are at least partially positioned in a slidable manner within workpiece engaging means 77. The respective positioning of first resilient means 101 and second resilient 103 is also shown. Additionally, rod members 59 of guide means 57 are illustrated in their established positions. Delay means 117 is illustrated as being positively secured within bar 69 of tool retention means 65 and having the described second end portions 125 in engaged relationship with workpiece engaging means 77.

In FIG. 4, upper ram 13 of die apparatus 11 has been actuated and engages bar 69 to move tool retention means 65 and workpiece engaging means 77 toward die retention means 29 at a substantially uniform rate. That is, due to the strategic positioning of first resilient spacing means 101, these members maintain a fixed spaced relationship during this initial downward travel. As can further be seen, working portions 85 of tool means 83 maintain their respective positions within workpiece engaging means 77. The workpiece engaging means 77 is illustrated as having now engaged workpiece 23. This is assured by the mating of a protruding portion 131 of a securedly positioned insert 133 which mates with the indented workpiece 23. The aforementioned insert 133 is secured within workpiece engaging means 77 using a snug fit. It is understood, however, that insert 133 is not an essential component of subassembly 10 in that workpiece engaging means 77 could be provided with the necessary openings therein for having working portions 85 of the tool means 83 positioned therein. For ease of assembly purposes however, it is preferred to use the desired insert with the necessary protruding portion 131 thereon. Should it be desired to perform operations to workpieces of varying cross sectional configurations, the only change required to subdie assembly 10 would be the replacement of another insert 133 which in turn would include a correspondingly modified protruding portion.

In FIG. 5, subdie assembly 10 is illustrated in its furthermost downward position necessary to achieve the described operation. As shown, working portions 85 of tool means 83 have passed fully through workpiece engaging means 77 as well as workpiece 23 and die means 51. Thus, the required punching of workpiece 23 is achieved. As can further be seen in FIG. 5, each of the elongated members 119 of the described delay means 117 have been movably displaced from workpiece engaging means 77. That is, second end portions 125 are now illustrated as having exited the corresponding receptive areas within engaging means 77.

When upper ram 13 of die apparatus 11 returns to its normally open position as illustrated in FIG. 3, the described tool retention means 65 will be also upwardly displaced in a direction away from die retention means 29. As can be seen with reference to FIGS. 3–5, tool retention means 65 will continue in its upward movement for a predetermined period of time until the second portions 125 of delay means 117 again engage workpiece engaging means 77. At this time, the workpiece engaging means 77 will also become upwardly displaced. Thus, a delay means has been provided in order that workpiece engaging means 77 will be retained against workpiece 23 until removal of working portion 85 of tool means 83 from the workpiece is achieved.

Figure 7:
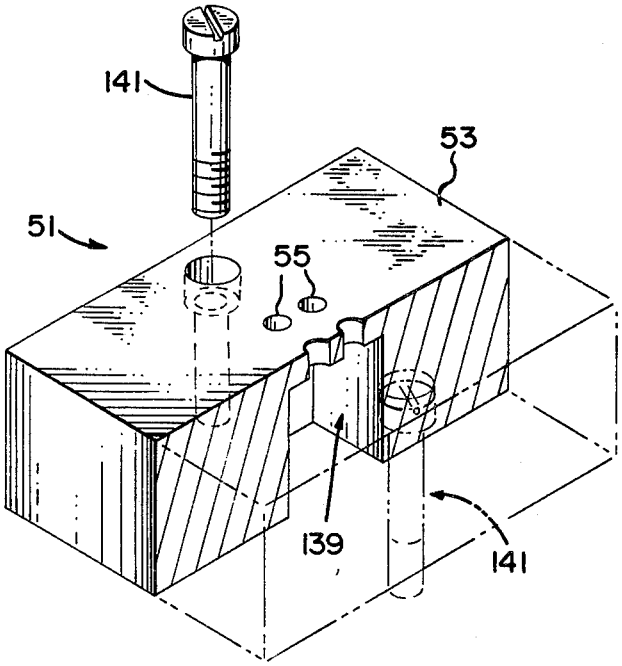
FIG. 7 is an enlarged isometric view of the preferred die means of the present invention.

In FIG. 7, a more detailed view of die means 51 is shown. As previously described, die means 51 comprises a receiving member 53 having a plurality of openings 55 therein. Thus, the working portions 85 of tool means 83 may easily pass therethrough to remove the extracted or punched out portions of workpiece 23. Removal of the described waste portions of workpiece 23 is further facilitated by the provision of an open channel or similar recessed portion 139 within receiving member 53. In turn, receiving member 53 is positively secured to die retention means 29 via two retaining screws 141.

Thus there has been shown and described a subdie assembly for performing a specified operation on a workpiece within a larger die apparatus wherein the subdie assembly is readily adaptable for being removed from the die apparatus to facilitate repairs to said assembly. By providing a means whereby a substantially similar assembly may be readily substituted therefore, the present invention assures that the downtime periods for the die apparatus will be substantially reduced.

While there has been shown and described what is at present considered the preferred embodiment of the invention, it will be obvious to those skilled in the art that various changes and modifications may be made therein without departing from the scope of the invention as defined by the appended claims.

What is claimed is:

1. A removable subdie assembly for performing a specified operation on a workpiece within a larger die apparatus adapted for performing a series of operations on said workpiece, wherein said die apparatus includes an upper ram member and a lower base member, said subdie assembly comprising:

die retention means affixed to said lower base member of said die apparatus and adapted for being removed therefrom;

die means securedly positioned within said die retention means for having said workpiece positioned thereon;

guide means having a first portion affixed to said die retention means and a second portion extending therefrom;

tool retention means unattached to said upper ram member of said die apparatus and movably oriented on said extending second portion of said guide means for aligned movement toward and away from said die retention means during performance of said specified operation on said workpiece and for being engaged by said upper ram member of said die apparatus during actuation of said ram member;

workpiece engaging means movably oriented on said extending second portion of said guide means between said die retention means and said tool retention means for aligned movement toward and away from said die retention means during performance of said specified operation on said workpiece and for engaing said workpiece positioned on said die means;

tool means securedly positioned within said tool retention means and having a working portion extending therefrom for passing through said workpiece engaing means to perform said specified operation on said workpiece during movement of said tool retention means twoard said die retention means;

first resilient spacing means positioned between said tool retention means and said workpiece engaging means for maintaining said tool retention means and said workpiece engaging means in spaced relationship; and second resilient spacing means positioned between said tool retention means and said die retention means for maintaining said tool retention means and said die retention means in spaced relationship.

2. The subdie assembly according to claim 1 further including means for providing delayed movement of said workpiece engaging means away from said die retention means with respect to said movement of said tool retention means away from said die retention means.

3. The subdie assembly according to claim 1 wherein said die retention means comprises a housing member having upper and lower opposing surfaces, said upper surface having a recessed portion therein for having said die means positioned therein, said lower surface adapted for engaging said lower base member of said die apparatus.

4. The subdie assembly according to claim 1 wherein said die means comprises a receiving member having at least one opening therein for receiving said working portion of said tool means during movement of said tool retention means toward said die retention means.

5. The subdie assembly according to claim 1 wherein said guide means comprises at least two upstanding rod members, each of said members having a first end securedly retained within said die retention means and a second end extending therefrom in a substantially upward direction.

6. The subdie assembly according to claim 1 wherein said tool retention means comprises a housing member having a lower surface including an indented portion therein for having said tool means securedly positioned therein.

7. The subdie assembly according to claim 1 wherein said workpiece engaging means comprises an elongated plate member having upper and lower opposiing surfaces, said lower surface adapted for engaging said workpiece positioned on said die means.

8. The subdie assembly according to claim 1 wherein said tool means comprises at least one punch member having a first end portion securedly positioned within said tool retention means and a protruding working end portion extending therefrom in a substantially downward direction.

9. The subdie assembly according to claim 1 wherein said first resilient spacing means comprises at least two spring members, each of said spring members having a first end portion positioned in engaged relationship to said tool retention means and a second end portion positioned in engaged relationship to said workpiece engaging means.

10. The subdie assembly according to claim 1 wherein said second resilient spacing means comprises a plurality of spring members, each of said spring members having a first end portion positioned in engaged relationship to said tool retention means and a second end portion positioned in engaged relationship to said die retention means.

11. The subdie assembly according to claim 2 wherein said means for providing delayed movement of said workpiece engaging means with respect to said movement of said tool retention means away from said die retention means comprises at least two elongated members each of said elongated members having a first end portion affixed to said tool retention means, and intermediate portion for being movably oriented within said workpiece engaging means, and a second end portion for positively engaging said workpiece engaging means during movement of said tool retention means away from said die retention means.

* * * * *